US008116665B2

(12) United States Patent
Watanabe et al.

(10) Patent No.: US 8,116,665 B2
(45) Date of Patent: Feb. 14, 2012

(54) IMAGE FORMING APPARATUS AND IMAGE FORMING METHOD

(75) Inventors: Takeshi Watanabe, Kanagawa-ken (JP); Minoru Yoshida, Tokyo (JP); Masahi Takahashi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/954,048

(22) Filed: Nov. 24, 2010

(65) Prior Publication Data

US 2011/0069996 A1 Mar. 24, 2011

Related U.S. Application Data

(63) Continuation of application No. 11/621,806, filed on Jan. 10, 2007, now Pat. No. 7,865,091.

(51) Int. Cl.
*G03G 15/00* (2006.01)

(52) U.S. Cl. ..... 399/258

(58) Field of Classification Search ..... 399/258, 399/302, 308

See application file for complete search history.

(56) References Cited

U.S. PATENT DOCUMENTS

| | | | | |
|---|---|---|---|---|
| 5,436,703 | A | 7/1995 | DeYoung et al. | |
| 5,978,638 | A | 11/1999 | Tanaka et al. | |
| 6,026,269 | A | 2/2000 | Setoriyama | |
| 6,253,038 | B1 | 6/2001 | Ito et al. | |
| 2001/0022906 | A1 | 9/2001 | Kawai et al. | |
| 2004/0030032 | A1 | 2/2004 | Manabe et al. | |
| 2004/0170451 | A1 | 9/2004 | Iwai | |
| 2005/0031383 | A1 | 2/2005 | Watanabe et al. | |
| 2005/0158071 | A1 * | 7/2005 | Hosokawa et al. | 399/103 |
| 2005/0207788 | A1 | 9/2005 | Bandou et al. | |
| 2005/0213999 | A1 | 9/2005 | Hirobe | |
| 2005/0220478 | A1 * | 10/2005 | Ai et al. | 399/101 |
| 2006/0029431 | A1 | 2/2006 | Tanaka et al. | |
| 2006/0062599 | A1 | 3/2006 | Shimmura et al. | |
| 2006/0204263 | A1 * | 9/2006 | Watanabe | 399/66 |

(Continued)

FOREIGN PATENT DOCUMENTS

JP 10090991 A 4/1998

(Continued)

OTHER PUBLICATIONS

Office Action for U.S. Appl. No. 11/621,806 mailed on Aug. 20, 2009.

(Continued)

*Primary Examiner* — Quana M Grainger
(74) *Attorney, Agent, or Firm* — Turocy & Watson, LLP

(57) ABSTRACT

A technology for controlling the generation of damages of a photoconductive surface caused due to the attachment of a carrier to a photoconductor in an image forming apparatus using a two-component developing agent is provided. An image forming apparatus is configured to include an intermediate transfer body having prescribed elasticity on a transfer surface onto which a toner image is transferred; plural image carriers which transfer a toner image onto the transfer surface and which are disposed along a movement direction of the transfer surface of the intermediate transfer body; plural development sections which form toner images having a different color from each other with respect to the plural image carriers by using a two-component developing agent made of a toner and a carrier; and developing agent replenishment sections which replenish a toner and a carrier in the development sections.

12 Claims, 13 Drawing Sheets

U.S. PATENT DOCUMENTS

| | | | |
|---|---|---|---|
| 2006/0210322 | A1 | 9/2006 | Watanabe et al. |
| 2007/0092300 | A1 | 4/2007 | Aruga et al. |
| 2007/0122181 | A1 | 5/2007 | Kamijo et al. |

FOREIGN PATENT DOCUMENTS

| | | | |
|---|---|---|---|
| JP | 2000118022 | A | 4/2000 |
| JP | 2002174942 | A | 6/2002 |
| JP | 2002304024 | A | 10/2002 |
| JP | 2002304066 | A | 10/2002 |
| JP | 2003029550 | A | 1/2003 |
| JP | 2005338701 | A | 12/2005 |
| JP | 2006235052 | A | 9/2006 |

OTHER PUBLICATIONS

Office Action for U.S. Appl. No. 11/621,806 mailed on Feb. 6, 2009.
Office Action for U.S. Appl. No. 11/621,806 mailed on Aug. 28, 2008.
Office Action for U.S. Appl. No. 11/621,806 mailed on Apr. 28, 2010.

* cited by examiner

FIG.8

| | Carrier particle size | | | Evaluation item | 5,000 sheets in total | 20,000 sheets in total | 25,000 sheets in total | 30,000 sheets in total | 35,000 sheets in total | 40,000 sheets in total |
|---|---|---|---|---|---|---|---|---|---|---|
| | | | | | Normal temperature and normal humidity environment | | High temperature and high humidity environment | | Low temperature and low humidity environment | |
| | | | | | After printing of 5,000 sheets | After printing of 20,000 sheets | After printing of 5,000 sheets | After printing of 10,000 sheets | After printing of 5,000 sheets | After printing of 10,000 sheets |
| Case of adjusting low-density part by background potential | 35 μm | Invention not applied | Second station | HT unevenness | ○ | × | | | | |
| | | | | Solid unevenness | ○ | × | | | | |
| | | | Fourth station | HT unevenness | | | | | | |
| | | | | Solid unevenness | | | | | | |
| | | Invention applied | Second station | HT unevenness | ○ | ○ | ○ | ○ | ○ | ○ |
| | | | | Solid unevenness | ○ | ○ | ○ | ○ | ○ | ○ |
| | | | Fourth station | HT unevenness | ○ | ○ | ○ | ○ | ○ | ○ |
| | | | | Solid unevenness | ○ | ○ | ○ | ○ | ○ | ○ |
| Case of adjusting solid density by T/C | | Invention not applied | Second station | HT unevenness | ○ | △ | △ | × | | |
| | | | | Solid unevenness | ○ | ○ | ○ | × | | |
| | | | Fourth station | HT unevenness | ○ | × | | | | |
| | | | | Solid unevenness | ○ | △ | | | | |
| | | Invention applied | Second station | HT unevenness | ○ | ○ | ○ | ○ | ○ | ○ |
| | | | | Solid unevenness | ○ | ○ | ○ | ○ | ○ | ○ |
| | | | Fourth station | HT unevenness | ○ | ○ | ○ | ○ | ○ | ○ |
| | | | | Solid unevenness | ○ | ○ | ○ | ○ | ○ | ○ |
| Case of adjusting low-density part by background potential | 40 μm | Invention not applied | Second station | HT unevenness | ○ | △ | △ | × | | |
| | | | | Solid unevenness | ○ | ○ | ○ | × | | |
| | | | Fourth station | HT unevenness | ○ | × | | | | |
| | | | | Solid unevenness | ○ | △ | | | | |
| | | Invention applied | Second station | HT unevenness | ○ | ○ | ○ | ○ | ○ | ○ |
| | | | | Solid unevenness | ○ | ○ | ○ | ○ | ○ | ○ |
| | | | Fourth station | HT unevenness | ○ | ○ | ○ | ○ | ○ | ○ |
| | | | | Solid unevenness | ○ | ○ | ○ | ○ | ○ | ○ |
| Case of adjusting solid density by T/C | | Invention not applied | Second station | HT unevenness | ○ | ○ | ○ | ○ | ○ | × |
| | | | | Solid unevenness | ○ | ○ | ○ | △ | △ | × |
| | | | Fourth station | HT unevenness | ○ | ○ | ○ | △ | × | |
| | | | | Solid unevenness | ○ | ○ | ○ | △ | △ | |
| | | Invention applied | Second station | HT unevenness | ○ | ○ | ○ | ○ | ○ | ○ |
| | | | | Solid unevenness | ○ | ○ | ○ | ○ | ○ | ○ |
| | | | Fourth station | HT unevenness | ○ | ○ | ○ | ○ | ○ | ○ |
| | | | | Solid unevenness | ○ | ○ | ○ | ○ | ○ | ○ |

○: Density unevenness, white spot or streak is not substantially observed.
△: Though unevenness or streak is slightly observed, such falls within a practically useful range.
×: NG because density unevenness or streak is observed.

FIG. 9

| | Belt speed difference | | | | Initial state | After printing of 5,000 sheets | After printing of 10,000 sheets | After printing of 20,000 sheets | After printing of 30,000 sheets | After printing of 40,000 sheets | After printing of 50,000 sheets |
|---|---|---|---|---|---|---|---|---|---|---|---|
| | | | | | Normal temperature and normal humidity environment | | | | | | |
| Case of adjusting low-density part by background potential | No | Invention not applied | Second station | HT unevenness | ○ | ○ | ○ | × | | | |
| | | | | Solid unevenness | ○ | ○ | ○ | × | | | |
| | | | Fourth station | HT unevenness | ○ | ○ | △ | × | | | |
| | | | | Solid unevenness | ○ | ○ | ○ | × | | | |
| | Yes (1 %) | Invention not applied | Second station | HT unevenness | ○ | ○ | × | | | | |
| | | | | Solid unevenness | ○ | ○ | ○ | | | | |
| | | | Fourth station | HT unevenness | ○ | ○ | × | | | | |
| | | | | Solid unevenness | ○ | ○ | ○ | | | | |
| | | Invention applied | Second station | HT unevenness | ○ | ○ | ○ | ○ | ○ | ○ | ○ |
| | | | | Solid unevenness | ○ | ○ | ○ | ○ | ○ | ○ | ○ |
| | | | Fourth station | HT unevenness | ○ | ○ | ○ | ○ | ○ | ○ | ○ |
| | | | | Solid unevenness | ○ | ○ | ○ | ○ | ○ | ○ | ○ |

○: Density unevenness, white spot or streak is not substantially observed.

△: Though unevenness or streak is slightly observed, such falls within a practically useful range.

×: NG because density unevenness or streak is observed.

FIG. 11

| | | | | | Initial state | After printing of 5,000 sheets | After printing of 10,000 sheets | After printing of 20,000 sheets | After printing of 30,000 sheets | After printing of 40,000 sheets | After printing of 50,000 sheets |
|---|---|---|---|---|---|---|---|---|---|---|---|
| | | | | | Normal temperature and normal humidity environment | | | | | | |
| Case of adjusting low-density part by background potential | Usual process provided with cleaner | Invention not applied | Second station | HT unevenness | ○ | ○ | ○ | × | | | |
| | | | | Solid unevenness | ○ | ○ | ○ | × | | | |
| | | | Fourth station | HT unevenness | ○ | ○ | △ | × | | | |
| | | | | Solid unevenness | ○ | ○ | ○ | × | | | |
| | Cleaner-less process | Invention not applied | Second station | HT unevenness | ○ | △ | × | | | | |
| | | | | Solid unevenness | ○ | ○ | ○ | | | | |
| | | | Fourth station | HT unevenness | ○ | × | | | | | |
| | | | | Solid unevenness | ○ | ○ | | | | | |
| | | Invention applied | Second station | HT unevenness | ○ | ○ | ○ | ○ | ○ | ○ | ○ |
| | | | | Solid unevenness | ○ | ○ | ○ | ○ | ○ | ○ | ○ |
| | | | Fourth station | HT unevenness | ○ | ○ | ○ | ○ | ○ | ○ | ○ |
| | | | | Solid unevenness | ○ | ○ | ○ | ○ | ○ | ○ | ○ |

○: Density unevenness, white spot or streak is not substantially observed.

△: Though unevenness or streak is slightly observed, such falls within a practically useful range.

×: NG because density unevenness or streak is observed.

FIG.12

| | | | | | Initial state | After printing of 5,000 sheets | After printing of 10,000 sheets | After printing of 20,000 sheets | After printing of 30,000 sheets | After printing of 40,000 sheets | After printing of 50,000 sheets |
|---|---|---|---|---|---|---|---|---|---|---|---|
| | | | | | Normal temperature and normal humidity environment | | | | | | |
| Case of adjusting low-density part by background potential | Provided with cleaner & roller charging (AC + DC) | Invention not applied | Second station | HT unevenness | ○ | ○ | ○ | × | | | |
| | | | | Solid unevenness | ○ | ○ | ○ | × | | | |
| | | | Fourth station | HT unevenness | ○ | ○ | △ | × | | | |
| | | | | Solid unevenness | ○ | ○ | ○ | × | | | |
| | Provided with cleaner & corona charging | | Second station | HT unevenness | ○ | ○ | ○ | × | | | |
| | | | | Solid unevenness | ○ | ○ | ○ | × | | | |
| | | | Fourth station | HT unevenness | ○ | ○ | △ | × | | | |
| | | | | Solid unevenness | ○ | ○ | ○ | × | | | |
| | Cleaner-less & roller charging (AC + DC) | | Second station | HT unevenness | ○ | △ | × | | | | |
| | | | | Solid unevenness | ○ | ○ | ○ | | | | |
| | | | Fourth station | HT unevenness | ○ | × | | | | | |
| | | | | Solid unevenness | ○ | ○ | | | | | |
| | Cleaner-less & corona charging | | Second station | HT unevenness | ○ | ○ | △ | × | | | |
| | | | | Solid unevenness | ○ | ○ | ○ | × | | | |
| | | | Fourth station | HT unevenness | ○ | ○ | △ | × | | | |
| | | | | Solid unevenness | ○ | ○ | ○ | × | | | |
| | Cleaner-less process & roller charging (AC + DC) | Invention applied | Second station | HT unevenness | ○ | ○ | ○ | ○ | ○ | ○ | ○ |
| | | | | Solid unevenness | ○ | ○ | ○ | ○ | ○ | ○ | ○ |
| | | | Fourth station | HT unevenness | ○ | ○ | ○ | ○ | ○ | ○ | ○ |
| | | | | Solid unevenness | ○ | ○ | ○ | ○ | ○ | ○ | ○ |

○: Density unevenness, white spot or streak is not substantially observed.
△: Though unevenness or streak is slightly observed, such falls within a practically useful range.
×: NG because density unevenness or streak is observed.

FIG.14

| | | | | | Initial state | After printing of 5,000 sheets | After printing of 10,000 sheets | After printing of 20,000 sheets | After printing of 30,000 sheets | After printing of 40,000 sheets | After printing of 50,000 sheets |
|---|---|---|---|---|---|---|---|---|---|---|---|
| | | | | | Normal temperature and normal humidity environment | | | | | | |
| Background contrast: 125 v<br>T/C: 7.5 %<br>Fixed<br>Provided with photoconductive cleaner<br>Carrier having a size of 35 μm | Corona charging | Invention not applied | Second station | HT unevenness | ○ | ○ | ○ | ○ | ○ | ○ | ○ |
| | | | | Solid unevenness | ○ | ○ | ○ | ○ | ○ | ○ | ○ |
| | | | Fourth station | HT unevenness | ○ | ○ | ○ | ○ | ○ | ○ | ○ |
| | | | | Solid unevenness | ○ | ○ | ○ | ○ | ○ | ○ | ○ |
| | Brush charging (DC) | | Second station | HT unevenness | ○ | △ | × | | | | |
| | | | | Solid unevenness | ○ | △ | × | | | | |
| | | | Fourth station | HT unevenness | ○ | × | | | | | |
| | | | | Solid unevenness | ○ | △ | | | | | |
| | | Invention applied | Second station | HT unevenness | ○ | ○ | ○ | ○ | ○ | ○ | ○ |
| | | | | Solid unevenness | ○ | ○ | ○ | ○ | ○ | ○ | ○ |
| | | | Fourth station | HT unevenness | ○ | ○ | ○ | ○ | ○ | ○ | ○ |
| | | | | Solid unevenness | ○ | ○ | ○ | ○ | ○ | ○ | ○ |

○: Density unevenness, white spot or streak is not substantially observed.
△: Though unevenness or streak is slightly observed, such falls within a practically useful range.
×: NG because density unevenness or streak is observed.

IMAGE FORMING APPARATUS AND IMAGE FORMING METHOD

CROSS-REFERENCE TO RELATED APPLICATIONS

This application is a Continuation of application Ser. No. 11/621,806 filed on Jan. 10, 2007, the entire contents of which are incorporated herein by reference.

BACKGROUND OF THE INVENTION

1. Field of the Invention

The present invention relates to image quality maintenance in an image forming apparatus achieving image forming processing using a two-component developing agent.

2. Description of the Related Art

As a technology for obtaining a color image with high image quality at a high speed, there has hitherto been known a configuration in which in an image forming apparatus of a so-called "quadruple tandem system", toner images of plural colors are superimposed and transferred on an intermediate transfer belt by process units disposed along the intermediate transfer belt and then transferred at once onto paper or the like.

According to the foregoing related-art technology, the "superimposition and transfer" which is liable to become unstable from the process standpoint is carried out on a stable intermediate transfer belt, thereby achieving the transfer with high image quality as it stands, and thereafter, secondary transfer is achieved at once on a final transfer material such as paper. Thus, multiplicity of use of paper can be improved while controlling the degradation of image quality to the minimum.

In image forming apparatus of such a configuration, a two-component development system which is advantageous for realizing high image quality is frequently employed. In recent years, by aiming to realize higher image quality of this two-component development, the particle size of a carrier to be used is becoming small.

In order to hold a color balance which is particularly important in superimposing colors, such an apparatus for high image quality is provided with a so-called image quality maintenance control mechanism in which in a state other than the time of image printing operation, after transferring a patch image on an intermediate transfer belt, a patch density, a reflectance, or the like is detected by a reflectance sensor or the like provided within the apparatus, thereby adjusting an image forming condition by that value.

As the image forming condition to be changed by the image quality maintenance control mechanism, for example, various conditions such as process conditions including charging bias voltage, development bias voltage, exposure amount and toner concentration (T/C) in a development unit and a combination of tone characteristics by changing an image processing pattern are known, and a combination of plural controls is employed.

However, among these conditions, for example, when a background contrast potential (a difference between charging potential and development potential of photoconductor) or a toner concentration within the development unit is controlled in a large range, in particular, in the case where the development system is a two-component system, there is involved a problem that a carrier particle easily attaches to the photoconductor. This means that in aiming to realize high image quality, the smaller the particle size of the carrier, the narrower the margin within which the condition can be changed.

Furthermore, in addition to the realization of high image quality, in order to make it compatible with realization of low costs or long life of the apparatus, when a brush charging unit which is strong against staining and low in costs is used as a charging member of the photoconductor, charging unevenness inherent to the brush is caused. In particular, streak-like potential unevenness in a direction of charging the photoconductor higher than a desired charging potential is inherent to a brush-like member and has a harm to easily generate the attachment of a carrier to the photoconductor in a development section.

Furthermore, for example, when a carrier attaches to a side of the photoconductor in a development section of an image forming station in the most upstream side of a quadruple tandem apparatus, this carrier is sandwiched at a transfer position against an intermediate transfer belt, whereby a surface of the photoconductor is rubbed and scratched. In addition, in the case where the carrier is transferred at the transfer position to a side of the intermediate transfer belt, since the carrier which has attached to the photoconductor in a first image forming station reaches the transfer section of second, third and fourth image forming stations, in particular, damages against the photoconductor become extreme in a later station. Then, the surface of the photoconductor is shaven by the carrier, and a number of crater-like recesses are generated. Thus, the image resolution is lowered, and a toner or an external additive of the toner further adheres to the surface of the photoconductor from the recesses, whereby faults such as a streak and a white spot are generated in an image. In addition, since a phenomenon in which the carrier attaches to the side of the photoconductor continues over a long period of time, the amount of the carrier within the development unit is reduced. Accordingly, the amount of a developing agent within the development unit is reduced, and density unevenness or the like is liable to be generated in printing a solid image.

That is, in order to aim to realize high image quality, in the case of a color printing apparatus using an intermediate transfer belt of a quadruple tandem system which employs two-component development with a carrier of a small particle size, it cannot be freely achieved in view of a problem of a harm of the carrier attachment phenomenon to largely control a background contrast potential or a toner concentration within a development unit for the purpose of aiming to improve the precision of a color balance or the like which is essential for realizing high image quality; and in the case where characteristics of a material vary with a change of the circumferential environment or a change with time, a process condition cannot be sufficiently controlled. Thus, it was impossible to obtain a synthetically sufficient high image quality. Furthermore, even when a brush-like charging member is employed for the purpose of aiming to realize both low costs and a long life at the same time, the same problems were caused.

SUMMARY OF THE INVENTION

An embodiment of the invention is to provide a technology for controlling the generation of damages of a photoconductive surface caused due to the attachment of a carrier to a photoconductor in an image forming apparatus using a two-component developing agent.

In order to solve the foregoing problems, an image forming apparatus according to an embodiment of the invention is configured to include an intermediate transfer body having prescribed elasticity on a transfer surface onto which a toner image is transferred; plural image carriers which transfer a toner image onto the transfer surface and which are disposed along a movement direction of the transfer surface of the intermediate transfer body; plural development sections which form toner images having a different color from each other with respect to the plural image carriers by using a two-component developing agent made of a toner and a carrier; and developing agent replenishment sections which replenish a toner and a carrier in the development sections.

Also, an image forming apparatus according to an embodiment of the invention is configured to include an intermediate transfer body having prescribed elasticity on a transfer surface onto which a toner image is transferred; plural image carriers which transfer a toner image onto the transfer surface and which are disposed along a movement direction of the transfer surface of the intermediate transfer body; plural development units which form toner images having a different color from each other with respect to the plural image carriers by using a two-component developing agent made of a toner and a carrier; and developing agent replenishment units which replenish a toner and a carrier in the development units.

Also, an image forming method according to an embodiment of the invention is an image forming method in an image forming apparatus transferring a toner image onto a transfer surface of an intermediate transfer body having prescribed elasticity by plural image carriers disposed along a movement direction of the transfer surface, which comprises replenishing a toner and a carrier in plural development sections which form toner images having a different color from each other with respect to the plural image carriers by using a two-component developing agent made of a toner and a carrier.

DESCRIPTION OF THE DRAWINGS

FIG. 8 is a table to show details of the experimental results.

FIG. 9 is a table to show the results of an experiment carried out by providing a speed difference between a photoconductor and an intermediate transfer belt.

FIG. 11 is a table to explain the effects brought by applying the invention in the configuration as illustrated in FIG. 10.

FIG. 12 is a table to show the results from comparison of a deterioration level of an image in a state of not applying the invention between the case of employing a corona charger and the case of employing a charging roller at the time of a cleaner-less process.

FIG. 14 is a table to show the experimental results of the apparatus configuration as illustrated in FIG. 13.

DESCRIPTION OF THE EMBODIMENTS

Embodiments of the invention are hereunder described with reference to the accompanying drawings.

Figure 1:
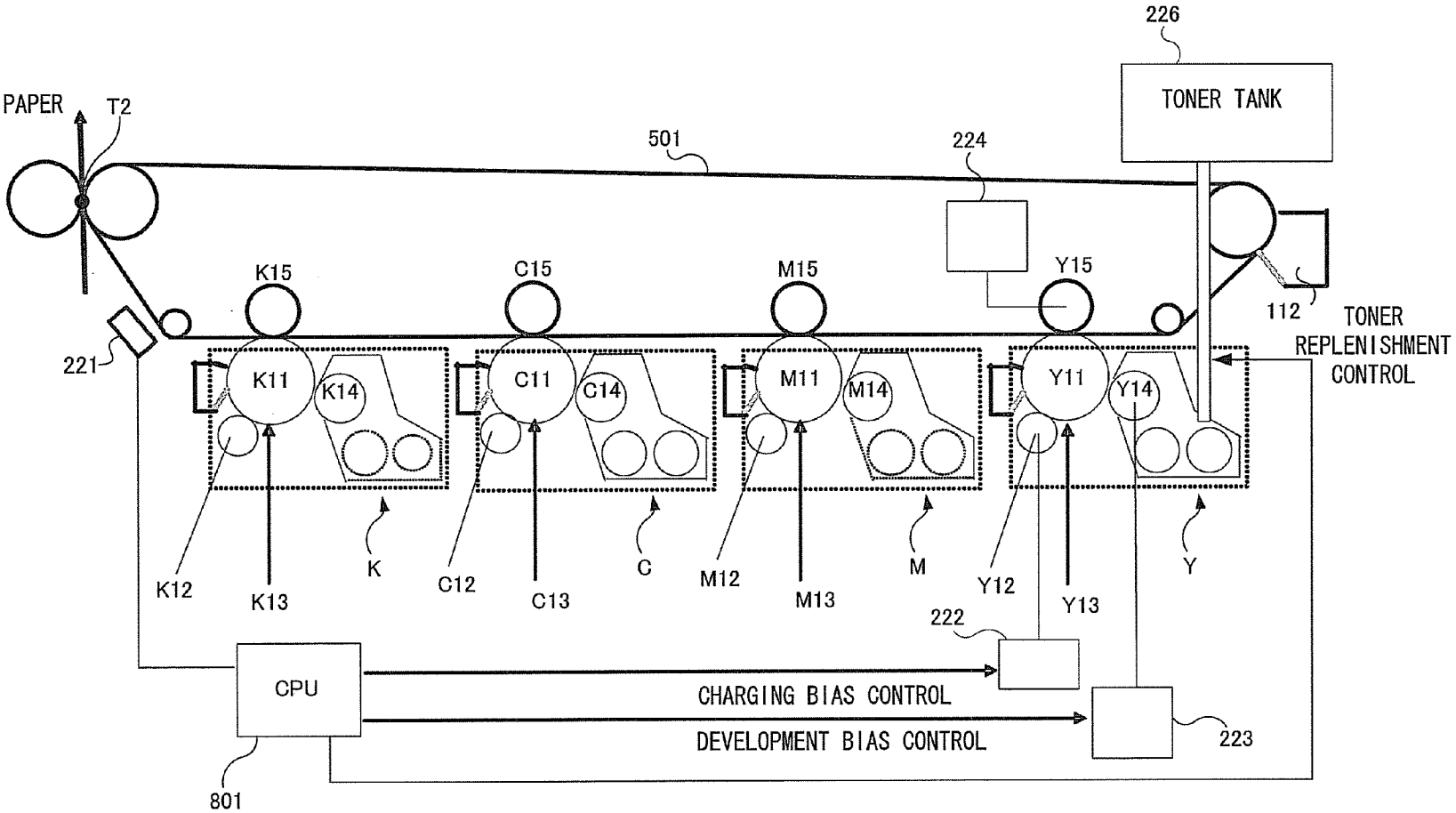
FIG. 1 is a view to show a configuration of an image forming apparatus according to an embodiment of the invention.

FIG. 1 is a view to show a configuration of an image forming apparatus according to an embodiment of the invention.

As illustrated in FIG. 1, an image forming apparatus according to the present embodiment employs an intermediate transfer system using an intermediate transfer belt as an intermediate transfer body. Furthermore, the image forming apparatus according to the present embodiment has a quadruple tandem configuration in which four process units K, C, M and Y of black, cyan, magenta and yellow are provided and these process units (image forming stations) are disposed along a movement direction of a belt surface of the intermediate transfer belt.

Details of the respective process units K, C, M and Y are hereunder described. Incidentally, the respective process units K, C, M and Y in the present embodiment have the same basic configuration. Here, details of the configuration of the process unit Y of yellow are described, and detailed descriptions of other process units K, C and M are omitted.

The process unit Y is provided with a photoconductor Y11, a charging roller Y12 and a development unit (development section) provided with a development roller Y14. Incidentally, the process unit Y integrally has at least one of the photoconductor Y11, the charging roller Y12 and the development unit and is attachable to or detachable from the main body of the image forming apparatus.

Though known materials such as OPC (organic photoconductor) and amorphous silicon (a-Si) are employable for the photoconductor Y11 in the present embodiment, OPC is used herein.

As a charging unit, for example, a scorotron charger, a charging roller, and the like can be used. However, in the present embodiment, the charging roller Y12 is employed, and an AC bias of pp2 kV (2 kHz) is applied to DC −650 V by a charging bias voltage application section 222 which is controlled by CPU 801, thereby charging OPC at −650 V.

In an exposure unit Y13, a laser, LED, and the like are used as a light source. For example, in the exposure unit Y13, a semiconductor laser having a wavelength of 700 nm is used, and a potential in an exposed portion of the photoconductor is lowered. At that time, it is preferable that the exposure amount is set up at from approximately a half decay exposure amount of the photoconductor to approximately four times thereof.

The image forming apparatus according to the present embodiment employs a two-component development system using a two-component development agent made of at least a toner and a carrier and achieves the development by forming napping on the development roller (magnetic roller) Y14 having a permanent magnet contained therein by the carrier and applying a DC bias or a (DC+AC) bias between the development roller Y14 and the surface of the photoconductor by a development bias voltage application section 223 which is controlled by the CPU 801.

Examples of the application method of a development bias voltage include superimposition of AC pp2 kV (6 kHz) on DC −500 V. As to the AC bias, there are made various devices for realizing high image quality such as employment of a square wave and changing of a duty ratio.

Under the foregoing condition, for example, when the exposure amount is approximately 1.3 times of a half decay exposure amount of the photoconductor Y11, a potential of the photoconductor after the exposure is approximately −250 V, and a difference between a potential in a non-image part of the photoconductor and the development bias (background contrast) is 150 V. Here, a difference between the development bias and the potential after the exposure (development contrast) is 250 V.

Subsequently, a toner image which has been developed on the photoconductor under such a condition is transferred onto an intermediate transfer belt 501 in a transfer section. The intermediate transfer belt 501 has semi-conductivity and is configured of a resin or a rubber or a stack member thereof having a thickness of from 50 to 2,000 μm. When the transfer member to which a transfer bias has been applied comes into contact with a surface of the intermediate transfer belt 501 in a side not opposing to a side of the photoconductor Y11, a transfer electric field is applied in a transfer nipping section where the photoconductor Y11 and the intermediate transfer belt 501 come into contact with each other or in the surroundings thereof.

In the present embodiment, a transfer roller Y15 using a conductive sponge having a volume resistivity of from 10e5 to 10e8 Ω·cm is brought into contact with a back surface of the intermediate transfer belt 501; and DC of from 300 V to 3,000 V is applied by a transfer bias voltage application section 224 which is controlled by the CPU 801, thereby transferring a toner image on the photoconductor onto the intermediate transfer belt 501. Then, by performing superimposition and transfer on the intermediate transfer belt 501 by these process units K, C, M and Y, a full-color image is formed and then transferred onto paper as a medium to be transferred at a secondary transfer position T2; and the image is thermally fixed by a non-illustrated fixing unit, thereby forming a final image.

In such a configuration, a single intermediate transfer body is present; and two steps of a primary transfer step for transferring a toner image onto the intermediate transfer belt 501 from the photoconductor Y11 and a secondary transfer step for superimposing and transferring toner images of four colors onto the intermediate transfer belt 501 by the primary transfer and then transferring them at once onto paper or the like are present.

Besides, there are also proposed a direct transfer system performing superimposition and transfer of plural colors directly onto paper from a photoconductor (a paper carrying transfer belt but not an intermediate transfer body); and a system transferring and carrying toner images via plural intermediate transfer bodies. However, the superimposition and transfer onto paper is unstable, and the transfer step always brings degradation of the image quality. Accordingly, taking into consideration the matter that the number of transfer is reduced as far as possible, a system employing the foregoing single intermediate transfer body is preferable in an apparatus aiming to realize high image quality.

Furthermore, in the respective image forming stations, a cleaning unit which removes the toner remaining on the photoconductor after the transfer is provided, and if desired, an antistatic treatment is further carried out. The photoconductor again goes to the charging step.

Next, the image quality maintenance control in the image forming apparatus according to the present embodiment is described.

A reflectance sensor 221 is set up in such a manner that the belt surface of the intermediate transfer belt 501 can be read. After transferring a prescribed patch image (prescribed image) onto the intermediate transfer belt 501 from the photoconductor Y11 by the CPU 801, a reflectance of color of the patch image formed by the respective image forming stations is detected by the reflectance sensor 221. Here, the function of the CPU 801 and the respective image forming stations is corresponding to a prescribed image forming section.

The reflectance of the patch image detected by the reflectance sensor 221 is acquired by the CPU 801. At that time, the function of the CPU 801 is corresponding to a fluctuation information acquiring section or a fluctuation information acquiring unit.

In many cases, the image quality maintenance control is classified into control for always keeping an image portion with high density such as a solid image constant; and control for finely adjusting an image portion with low density in a state that the image quality of the image portion with high density is kept. In performing such image quality maintenance control, the acquisition of detection data from the reflectance sensor 221 and the control of various bias voltages are achieved by the CPU 801.

As a method of adjusting the image quality of an image portion with high density including a solid image, various measures are known. The development amount of the image portion with high density can be basically controlled by the charging amount of the toner and the development contrast. For example, in the case where the exposure amount is set up at approximately two times or more of the half decay exposure amount of the photoconductor, the following method is generally employed.

For example, when the charging potential of the photoconductor Y11 is −450 V, the development bias voltage is −300 V and the potential after the exposure is −50 V, since the exposure amount is relatively large, even by changing the charging potential, the potential after the exposure is constant at −50 V. Then, the development contrast is adjusted by simultaneously changing the charging bias voltage and the development bias voltage, thereby making the background contrast potential constant. For example, when the charging amount of the toner is approximately −30 μC/g in a normal temperature and normal humidity environment, the development amount of the solid image is approximately 0.5 mg/cm$^2$ under the foregoing condition, and the final image density is approximately 1.5 and substantially adequate.

However, for example, when the charging amount of the toner increases to approximately −40 μC/g in a low temperature and low humidity environment, only approximately 0.3 mg/cm$^2$ of the image can be developed at a development contrast of 250 V, and the image density is approximately 1.1. Then, by detecting the patch image transferred onto the intermediate transfer belt 501 by the reflectance sensor 221, shifting the charging potential and the development bias voltage by 150 V to −600 V and −450 V, respectively and controlling the development contrast potential at 400 V, even when the charging amount of the toner is high, the adjustment is achieved so as to obtain a sufficient development amount.

Furthermore, as an example of controlling the charging amount of the toner, there is a method of adjusting the toner concentration in a development unit. In that case, when it is intended to increase the development amount, such can be achieved by excessively replenishing the toner. Though the toner concentration is usually from approximately 7 to 9%, when it is intended to more increase the development amount, by increasing the toner concentration to approximately 10% by replenishing the toner, the charging amount of the toner decreases even in a low temperature and low humidity environment, whereby an adequate image density is obtained.

Furthermore, in the establishment in which the exposure amount is relatively low (less than two times of the half decay exposure amount), by controlling the charging potential, the potential after the exposure fluctuates, too. Thus, the development amount is adjusted by controlling mainly the quantity of light. For example, in controlling the charging potential at −750 V, the development bias voltage at −600 V and the potential after the exposure at −350 V, respectively, in the case where the environment is similarly a low temperature and low humidity environment, by strengthening the quantity of light, the potential after the exposure becomes −200 V, thereby making the development contrast large.

Furthermore, even in such establishment, the method of adjusting the toner concentration in a development unit is, as a matter of course, effective.

As described above, after completion of the image quality adjustment of an image portion with high density including a solid image, the fine adjustment of the image quality of an image portion with low density is achieved. In the case of establishment in which the quantity of light is relatively large, the image quality can be controlled by changing the quantity of light or charging potential (background contrast) by the CPU 801. On the other hand, in the case of establishment in which the quantity of light is relatively small, when the quantity of light is changed, the image portion with high density also fluctuates. Accordingly, it is required to adjust the background contrast potential.

However, when the background contrast potential is carelessly adjusted, so-called "carrier attachment" in which the carrier attaches to the photoconductor side in the development section is generated.

When the background contrast potential is increased, this carrier attachment is more likely generated. On the other hand, when the background contrast potential is excessively small, a white background is fogged. Thus, a range (margin) wherein the background contrast potential can be adjusted becomes very narrow.

This margin of the background contrast potential becomes narrower in (1) the case where the carrier within the development unit is degraded due to the development processing over a long period of time and (2) the case where a particle size of a carrier particle used in the development unit is small. Thus, a range which can be adjusted becomes almost zero.

Figure 2:
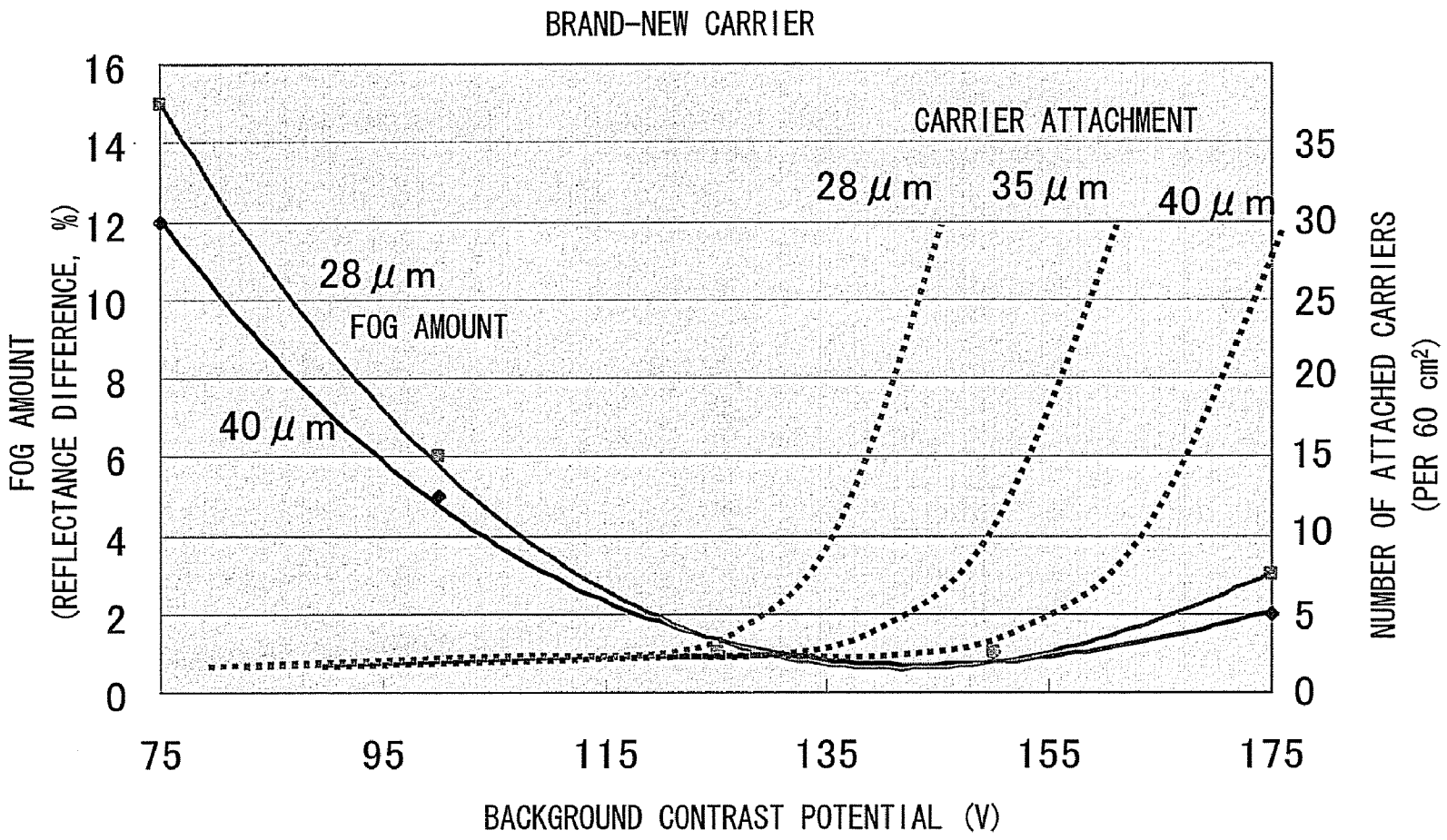
FIG. 2 is a graph to show the experimental results with respect to the relationship among the particle size of a carrier particle, the carrier attachment and the image fog amount.
Figure 3:
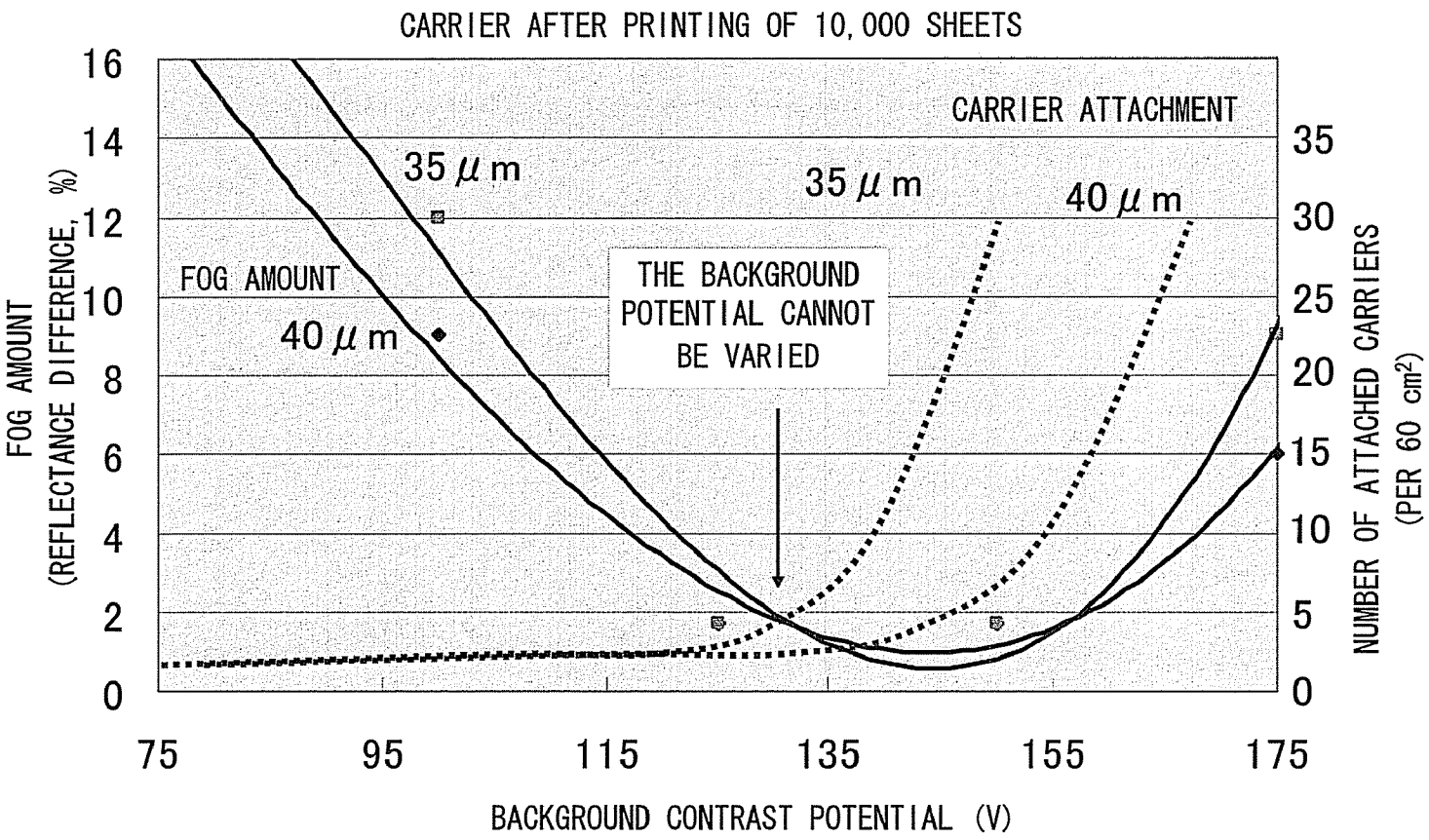
FIG. 3 is a graph to show the experimental results with respect to the relationship among the particle size of a carrier particle, the carrier attachment and the image fog amount.

FIGS. 2 and 3 are each a graph to show the experimental results with respect to the relationship among the particle size of a carrier particle, the carrier attachment and the image fog amount.

With respect to the "fog amount", the surface of the photoconductor was taped by a mending tape under a white background condition and measured for a reflectance by X-rite (registered trademark) in a stuck state on white paper, thereby determining a difference in reflectance from that in the case of not taping the surface of the photoconductor. Incidentally, a range wherein no problem is brought in view of image or apparatus is in general not more than 2%.

Also, with respect to the "carrier attachment amount", after taping the surface of the photoconductor by a mending tape in the same manner, the tape was stuck on plain color decorative paper, thereby counting the number of carriers attached to the tape. An area of the tape is 60 $cm^2$; and when the number of attached carriers is not more than 5 within this area, there is not particularly brought a significant problem in usual image forming apparatus. Needless to say, it is better that the number of attached carriers is small as far as possible. With respect to the particle size of the carrier particle, a range of from 0.1 to 200 μm was divided into 32 parts and measured by using a laser diffraction, scattering, particle size distribution analyzer (LA-950, manufactured by Horiba, Ltd.), and an average particle size of 50% of the volume distribution was defined as an average particle size.

In the experiment from which the data shown in FIG. 2 was obtained, a carrier in a relatively new state was used. It is understood that the smaller the particle size of the carrier, the narrower the tolerable range (margin) of the background contrast potential within which the fog amount and the carrier attachment can be controlled on adequate levels. FIG. 3 shows the results by the carrier after carrying out the test of printing of 10,000 sheets. According to this, it is understood that in the case of a carrier having a particle size of 40 μm, though the tolerable range of the background contrast potential has a width, whereas in the case of a carrier having a particle size of 35 μm, a fault is not a little caused unless the background contrast potential is fixed and employed.

In addition to the background contrast potential, the case where the toner concentration (T/C) within the development unit is largely changed also influences the margin of the carrier attachment. Incidentally, the term "T/C" as referred to herein means "(toner amount)/(whole amount of two-component developing agent)".

Figure 4:
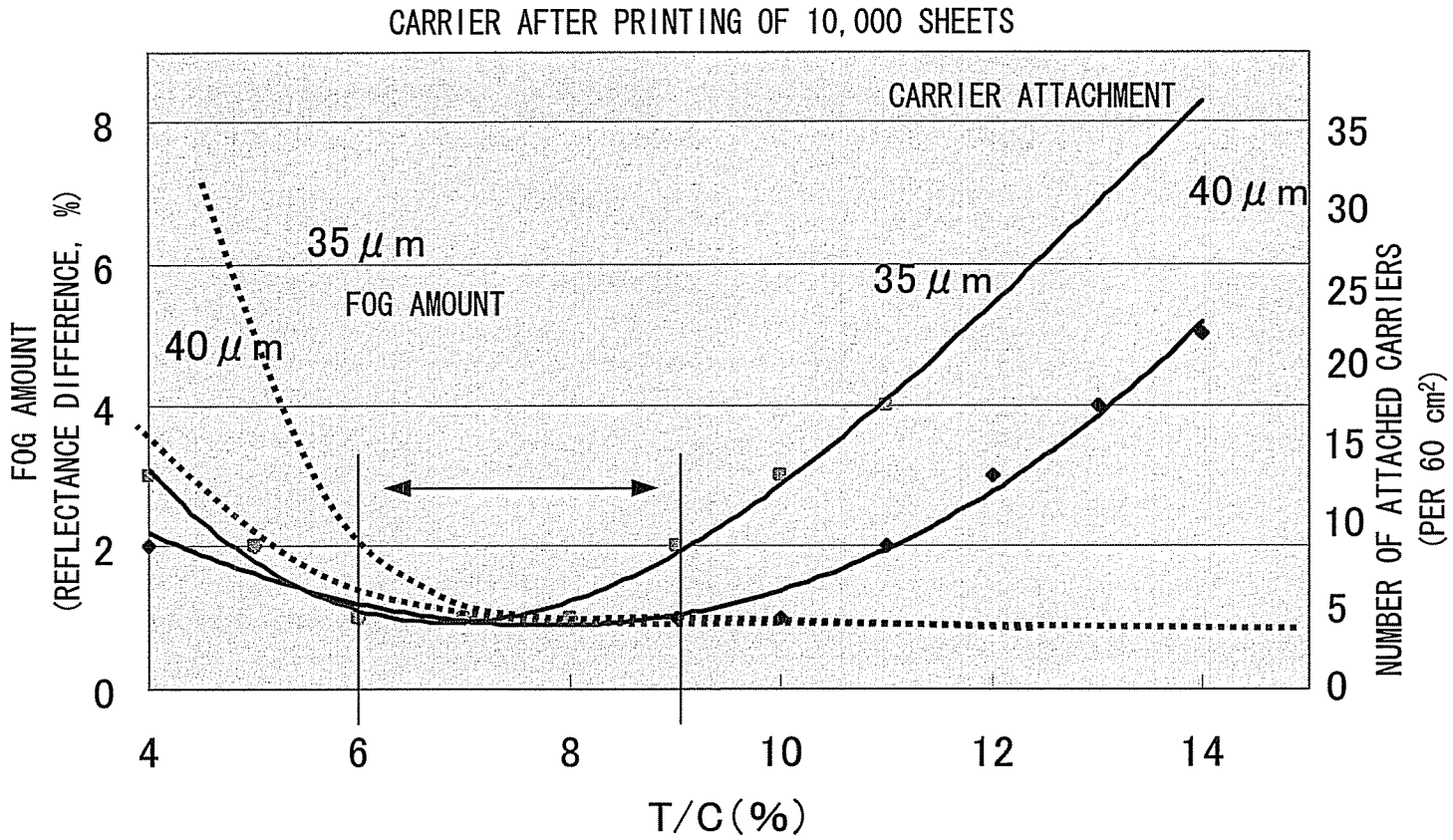
FIG. 4 is a graph to show the relationship between the carrier attachment and the fog when the toner concentration is changed.

FIG. 4 is a graph to show the relationship between the carrier attachment and the fog when the toner concentration is changed. The carrier after printing of 10,000 sheets was used. It is also understood that the smaller the particle size of the carrier, the narrower the margin of the carrier attachment; and that in the case of a carrier having a particle size of 35 μm, when the toner concentration is changed over a larger range than the range of from 6 to 9%, the margin of the fog and carrier attachment disappears. When the foregoing carrier attachment is generated, damages of the photoconductor, faults in image caused due to a reduction of the developing agent within the development unit, and the like are generated as described previously.

Figure 5:
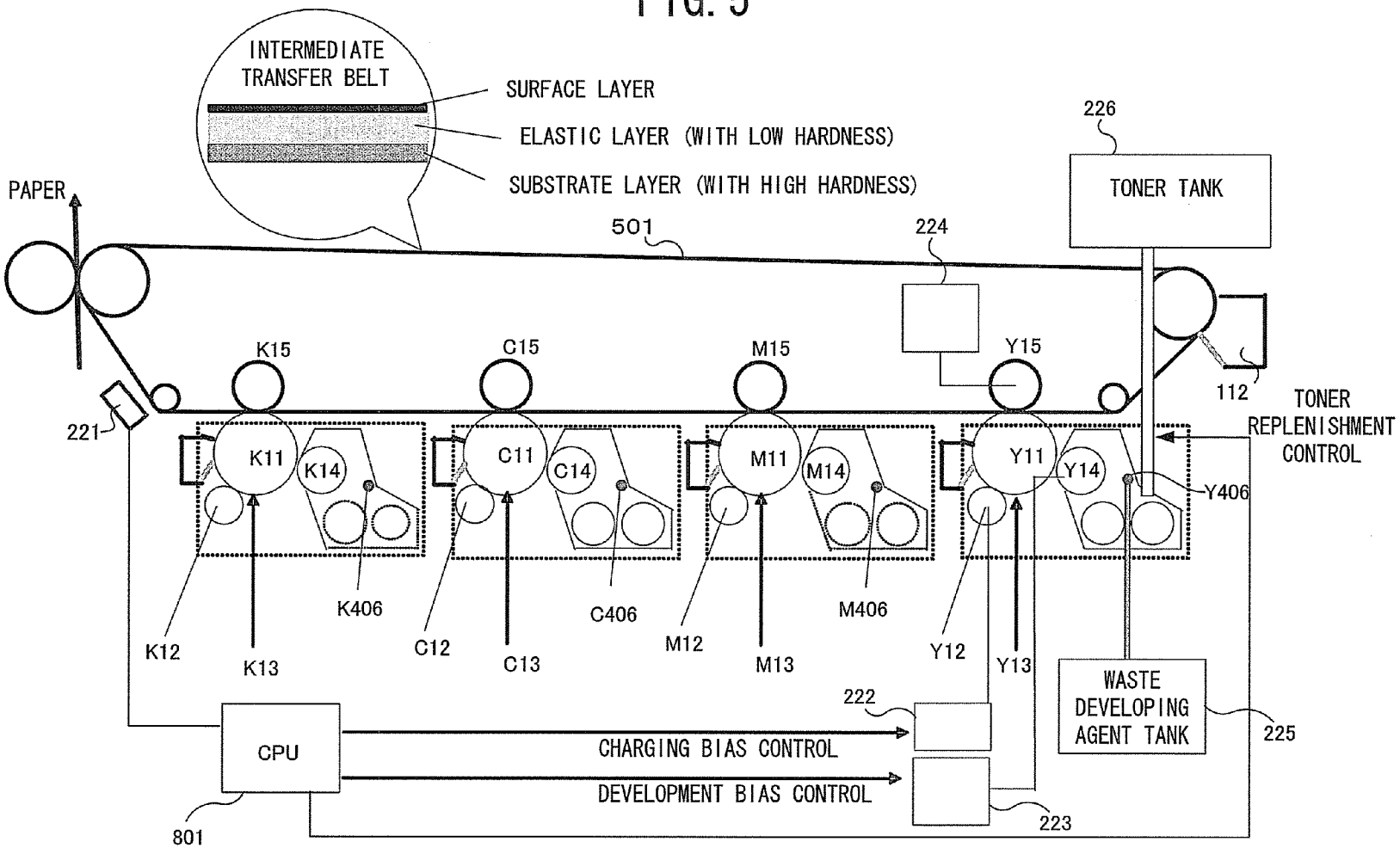
FIG. 5 is a view to explain details of a configuration of an image forming apparatus according to an embodiment of the invention.
Figure 6:
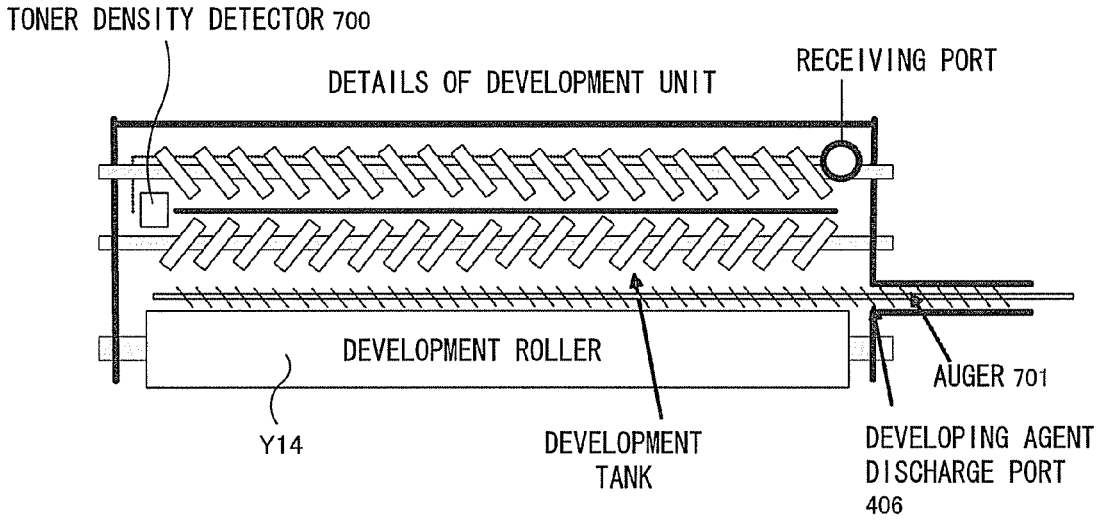
FIG. 6 is a view to explain details of a configuration of an image forming apparatus according to an embodiment of the invention.
Figure 7:
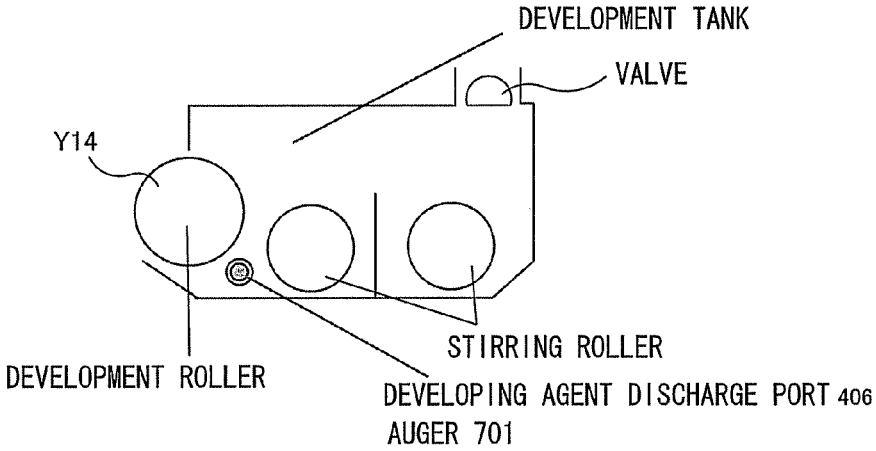
FIG. 7 is a view to explain details of a configuration of an image forming apparatus according to an embodiment of the invention.

Then, as illustrated in FIGS. 5 to 7, the image forming apparatus according to the present embodiment is configured so as to meet the following two requirements.

(1) In order that even when the carrier attachment is generated, damages of the photoconductor may not be generated, prescribed elasticity be imparted onto a transfer surface of an intermediate transfer belt to which a toner image is transferred from the photoconductor.

(2) In order that even when the carrier attachment is generated, a developing agent within a development unit may not be reduced, a two-component developing agent be replenished in the development unit step by step.

Examples of the intermediate transfer belt of the configuration (1) include a configuration in which a rubber layer is stacked as an elastic layer on a resin layer as a substrate layer; and a configuration in which a surface layer is further provided in the preceding configuration taking into consideration mold releasing properties on the surface or the like.

Concretely, for example, conditions of the respective layers configuring the intermediate transfer belt are as follows.

Substrate Layer

The substrate layer has a thickness of from approximately 50 to 150 μm, and known materials can be used so far as they are a resin such as polyamides. The substrate layer preferably has a volume resistivity of from 10e6 to 10e12 Ω·cm.

Elastic Layer

The elastic layer has a thickness of from approximately 100 to 500 μm and is made of a urethane rubber, a silicone rubber, an acrylic rubber, NBR, or the like. As a matter of course, expanded materials may be used. The elastic layer preferably has a hardness of from 20 to 70° and a volume resistivity of from 10e6 to 10e12 Ω·cm.

Surface Layer

The surface layer has a thickness of from approximately 2 to 50 μm and is prepared by spray coating a fluorocarbon based or silicone based coating material or thermally baking a fluorocarbon based resin (PFA). The surface layer preferably has a volume resistivity of from 10e8 to 10e14 Ω·cm.

Furthermore, in the case where slight out of color registration or the like is tolerable, a configuration in which an elastic layer made of a rubber, etc. is provided as the substrate layer and a surface layer is provided as a mold release layer may be employed. In that case, the foregoing configuration from which, however, the substrate layer is eliminated can be used. Incidentally, the belt surface of the intermediate transfer belt is designed so as to have elasticity to such a degree that in the case of sandwiching the carrier particle between the belt surface and the photoconductive surface, the surface of the photoconductor is not scratched. In this way, by setting up the hardness of the transfer surface of the intermediate transfer body at a prescribed hardness lower than that of the image carrying surface, namely at a hardness such that even when the carrier particle attaches onto the image carrying surface, the image carrying surface is not scratched, the generation of scratches caused due to the carrier attachment onto the image carrying surface can be controlled.

Next, the development unit of the configuration (2) is configured in such a manner that following the printing operation or the like, a carrier-containing developing agent is supplied from a toner tank 226 by step by step such that even when the carrier attachment is generated, the amount of the developing agent within the development unit is not reduced. Incidentally, the configuration of a development system as shown in the present embodiment is one example, and needles to say, it should not be construed that the invention is limited to a specific configuration of the development system in the present embodiment.

Examples of the development unit are illustrated on FIGS. 6 and 7. The development unit has a toner concentration (T/C) detector (for example, a permeability sensor) 700, and a mechanism (for example, a valve) for supplying a developing agent from a receiving port may be provided so as to obtain a previously set up toner concentration or a toner concentration value determined by the image quality maintenance control. The toner concentration detector 700 may bear a function to detect a degree of fluctuation (or information regarding the degree) in charging characteristics of the two-component developing agent in the development unit. At that time, the CPU 801 acquires a detection data in the toner concentration detector 700 as the information regarding the degree of fluctuation in charging characteristics of the two-component developing agent (at that time, the CPU 801 is corresponding to a fluctuation information acquisition section or a fluctuation information acquisition unit).

Furthermore, the development unit used in the present embodiment is configured to include a developing agent discharge port 406, from which the developing agent is automatically discharged step by step and sent to a waste toner tank. With respect to the control of the discharge amount, for example, a discharge operation may be controlled by the rotation, etc. of an auger 701 as a discharge unit of the developing agent as illustrated in FIGS. 6 and 7; and a so-called overflow system in which a partition from which when the amount of the developing agent within the development unit increases and becomes a fixed height or higher, the developing agent overflows is provided, or the port 406 or the like is provided in a side wall of the development unit, from which the developing agent is discharged, as illustrated in FIG. 5, may be employed.

The replenishment of the developing agent may be achieved by previously mixing a small amount of a carrier along with a toner in the toner tank 226 and gradually replenishing a small amount of the carrier by a developing agent replenishment mechanism (developing agent replenishment section) controlled by the CPU 801 corresponding to the consumed amount of the toner (on a basis of the information acquired in the fluctuation information acquisition section), or by separately controlling a toner and a carrier and replenishing them into the development unit. In any way, since the excessively thrown developing agent is discharged by a discharge system or an overflow system by an auger or the like, the developing agent within the development unit is kept constant without causing the matter that the amount of the developing agent is excessively high or excessively low. Accordingly, even when the carrier attachment is generated, since the foregoing replenishment and discharge are always carried out, the amount of the developing agent within the development unit is not influenced. That is, the subject development is of a development system of achieving the discharge along with the replenishment of a developing agent (toner and carrier).

As described above, the CPU 801 and the developing agent replenishment mechanism replenish the carrier together with the toner in replenishing the toner corresponding to the consumed toner by the development and gradually replace a small amount of the carrier within the development section, thereby controlling the fluctuation of charging characteristics. Thus, the CPU 801 (corresponding to the developing agent replenishment section or the developing agent replenishment unit) keeps the charging characteristics of the two-component developing agent within the development unit in a prescribed state by a developing agent replenishment and discharge development system.

Next, a confirmation test of the effect to be brought by the foregoing configuration is described. In this confirmation test, two kinds of carrier particles having a particle size of 35 μm and 40 μm were used.

Furthermore, phthalocyanine based OPC with a half decay exposure amount of 0.3 nj/cm$^2$ having a size of ϕ30 mm was used as the photoconductor.

The carrier attachment phenomenon is largely influenced by the carrier particle size, the background contrast potential and the toner concentration within the development unit. The measurement of the "carrier attachment amount" and the "fog amount" was carried out by the method of using a mending tape as described previously. In usual image forming apparatus, it is considered to be desirable that a tolerable level of the carrier attachment amount is not more than 5 per 60 cm$^2$ and that the "fog amount" is not more than 2%. In the carrier having a size of 35 μm in a standard toner concentration (T/C: from 7 to 9%), the background contrast potential was not more than 140 V, and the carrier attachment amount fell within the tolerable range; and in the carrier having a size of 40 μm, the background contrast potential was not more than 155 V. Furthermore, in all of these cases, when the background contrast potential was less than 120 V, the white background fog exceeded 2% (see FIG. 2).

In the experiment, since the charging potential of the photoconductor is set up at −700 V and the background contrast potential is set up at 125 V such that the carrier attachment is not generated, the development bias voltage was set up at −575 V. At that time, the development contrast for obtaining a desired solid concentration (ID=1.5) is −325 V in a normal temperature and normal humidity environment, and by adjusting the exposure amount, the potential of the photoconductor after the exposure was adjusted at −250 V. Then, at that time, when a tone area rate was 64/255, an image density (ID) was 0.2.

When the experimental apparatus was laid in a low temperature and low humidity environment in the foregoing state, a development contrast necessary for obtaining a desired solid density was required to be from −325 V to −400 V. Then, by setting up the exposure amount stronger than that at the time of normal temperature and normal humidity to adjust the potential after the exposure at −175 V, a solid density of ID=1.5 could be kept. However, at that time, the image density (ID) at a tone area rate of 64/255 became 0.25. Then, when the charging potential was adjusted by the CPU 801 to set up the background contrast potential at 140 V, the image density (ID) at a tone area rate of 64/255 became 0.2, whereby the image density of the image portion with low density could be made identical with that in the normal temperature and normal humidity environment.

However, in the case of using the carrier having a size of 35 μm, this condition that the background contrast potential is 140 V is a limit value within the margin of the carrier attachment amount. However, this is in a state of a brand-new carrier; and for example, in a long-used carrier as shown in FIG. 3, the carrier attachment exceeds the tolerable range and reaches an extent of 15 per 60 $cm^2$.

Furthermore, in the carrier having a particle size of 40 μm, under a condition the same as in the foregoing, though the carrier attachment falls within the tolerable range, it enters an increasing region. In such a method of adjusting mainly the background contrast potential to adjust a low density part, it is understood that a problem of the carrier attachment is liable to be generated. However, in a system of adjusting the quality of light to adjust the solid density as in the foregoing example, it is impossible to use the quantity of light as a parameter for adjusting the image portion with low density. Besides, a method of controlling an image pattern or the like is known as a measure for adjusting the image portion with low density. However, in the case of obtaining an image with high image quality which is free from the generation of tone jump or the like, it is also required to adjust the background contrast potential.

In the experiment, such a series of operations was achieved by a system in which a high-density patch and a low-density patch are printed on an intermediate transfer body; a reflectance is detected by a reflectance sensor; and a solid density and an image portion with low density are adjusted with an exposure amount and a background contrast potential, respectively by the CPU 801 (corresponding to a potential difference control section) (adjusted on a basis of information acquired in a fluctuation information acquisition section in such a manner that a difference between a charging potential on an image carrying surface of an image carrier and a potential to be applied in a development section becomes a prescribed potential difference). After printing of 20,000 sheets in a normal temperature and normal humidity environment (at 21° C. and 50%), printing of 10,000 sheets was performed in a high temperature and high humidity environment (at 30° C. and 80%), and printing of 10,000 sheets was further performed in a low temperature and low humidity environment (at 10° C. and 20%), thereby visually confirming the state of density unevenness (unevenness in ID) of a halftone image or the like and whether or not in continuous printing of a solid image on 3 sheets, density unevenness of the image was generated.

Concretely, it is meant that when a white spot or a streak is generated in the halftone image, a possibility that the surface of the photoconductor is damaged by the carrier is high; and that when density unevenness is generated in the solid image, the amount of the developing agent within the development unit is decreased and the follow-up properties to the solid image are deteriorated.

In the halftone image, the evaluation was visually made and graded as "○Δ×". In the solid image, the image density was measured at 56 points within the image by using a Macbeth densitometer. As a result, the case where all of the image densities fall within the range of from 1.4 to 1.6 is designated as "○"; the case where the image density is 1.35 or more is designated as "Δ"; and the case where the image density is lower than 1.35 and unevenness is observed is designated as "×".

Furthermore, in the case of adjusting the solid density by changing the toner concentration but not the exposure amount, the same confirmation as described above was performed, thereby examining any influence against the image quality. In the initial state under the foregoing condition, in the respective environments while fixing the exposure amount, the toner concentration at which a desired solid density (ID=1.5) can be obtained was 9% in a low temperature and low humidity environment, 7.5% in a normal temperature and normal humidity environment and 6% in a high temperature and high humidity environment, respectively. However, these values are values of the developing agent in the initial state, and actually, the toner concentration was adjusted by detecting a patch density on the intermediate transfer belt and automatically giving feedback by using an automatic toner sensor within the developing unit.

The establishment of these conditions was made common with respect to all of the image forming stations K, C, M and Y in the image forming apparatus of a quadruple tandem system. Furthermore, the same color toner was used in each of the stations, an image was formed at a printing ratio of 6% in each station under a condition that the image did not overlap, and continuous printing of an A4-size was performed. The evaluation of image was performed in a monochromatic image of the second and fourth stations, respectively.

The experimental results are shown in a table of FIG. 8. In the table of FIG. 8, the terms "Invention applied" mean that the experiment is carried out by a configuration of the present embodiment using an intermediate transfer belt having elasticity as a surface layer and employing a developing agent replenishment and discharge development system; and the terms "Invention not applied" mean that the experiment is carried out by a configuration using an intermediate transfer belt not having elasticity (for example, made of a single-layered polyimide) and not employing a developing agent replenishment and discharge development system. Furthermore, the terms "HT unevenness" mean a state that unevenness is generated in printing a halftone image; and the terms "solid unevenness" mean a state that unevenness is generated in printing a solid image.

First of all, in a method of adjusting the image portion with low density by background contrast control, in the case of using a small-sized carrier of 35 μm, in examples to which the invention is not applied, after printing of 20,000 sheets, a streak or a white spot was already generated in the halftone image in both the second station (cyan) and the fourth station (yellow), and density unevenness was also generated in the solid image. On the other hand, in the configuration of the image forming apparatus according to the present embodiment, even after printing of 40,000 sheets, good image quality could be kept in both the image forming stations.

Furthermore, in the case of adjusting the image portion with high density by the toner concentration in the development unit but not the exposure amount, since the image portion with low density was adjusted by the exposure amount, though the background contrast potential was not changed, when the invention was not applied, the state became "NG" at the time of printing of 30,000 sheets in the second station and "NG" at the time of printing of 20,000 sheets in the fourth station, respectively.

The reason why the deterioration of the image quality is vigorous in the fourth station resides in the matter that in an image forming station positioned in a more downstream side, a probability that the carrier in an image forming station positioned in an upstream side is carried via the intermediate transfer belt increases. It is understood that the invention is especially important in the intermediate transfer belt process of a quadruple tandem system. Here, when the invention was applied, no problem was caused until printing of 40,000 sheets.

On the other hand, in the case of using a carrier having an average particle size of 40 μm, the tendency was also the same, but a result that the image quality level was good as compared with the case of using a carrier having a particle size of 35 μm was brought.

Next, after adjusting the image portion with high density by the exposure amount, a speed difference was given between the photoconductor and the intermediate transfer belt in a combination with the adjustment of the image portion with low density by the background contrast potential, and the experiment was performed. The results obtained by setting up the photoconductor faster by about 1% and making the comparison are shown in a table of FIG. 9. In the present experiment, the image confirmation was performed every 10,000 sheets and the confirmation was achieved until 50,000 sheets in total in a normal temperature and normal humidity environment. The comparison between the case where the circumferential speed of the photoconductor was made faster by 1% than the circumferential speed of the intermediate transfer belt and the case where the former was not made faster reveals that in the case of giving a speed difference, unevenness (white spot or streak) of the halftone is liable to be generated in the related-art configuration, whereas a problem is not caused at all until 50,000 sheets in the image forming apparatus according to the present embodiment.

As described above, it has already been known that when a speed difference of from zero to several % is given between the surface of the photoconductor and the surface of the intermediate transfer belt, the transfer efficiency is improved, thereby making it possible to realize higher image quality. However, when the carrier attachment is generated in a usual intermediate transfer belt not having elasticity, since the transfer section is slid and rubbed due to the speed difference, damages against the photoconductor become more extreme. On the other hand, by employing the configuration according to the present embodiment, even when a speed difference is given, the damages against the photoconductor can be reduced, and the residual transfer amount can be reduced.

In addition, a confirmation experiment was also carried out with respect to the case of applying the invention to a cleaner-less process.

Figure 10:
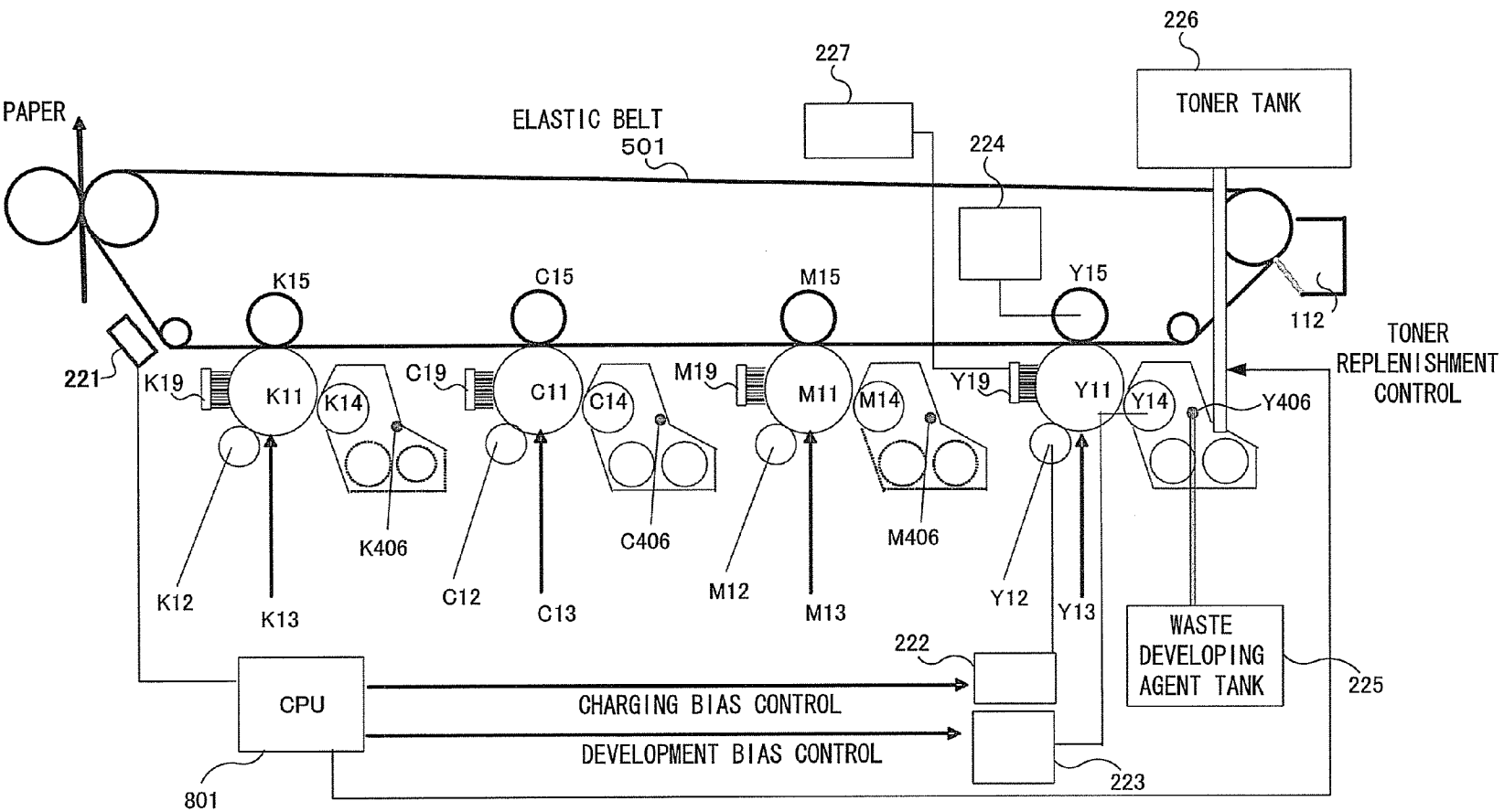
FIG. 10 is a view to show details of a configuration in which a brush is provided in place of a cleaning blade.

Under a condition of the present embodiment, as illustrated in FIG. 10, the cleaning blade of the photoconductor in each of the image forming stations was omitted; brushes K19, C19, M19 and Y19 of a fixed bar type were provided; and −400 V was applied. As the brushes K19, C19, M19 and Y19, though ones having a fiber size of from 1 to 10 dtex are suitable, a nylon-made brush having a fiber size of 4 dtex was used in the present experiment. Furthermore, as to the resistivity value of brush, though ones of from 10e4 to 10e10Ω are suitable, one of 10e7Ω was used in the present experiment. In the present experiment, a difference in circumferential speed between the photoconductor 11 and the intermediate transfer belt 501 was set up at substantially zero, and the comparison was made in the same manner as in FIG. 9. As a result, as shown in a table of FIG. 11, when the invention was not applied, a white streak and a white spot were generated in the halftone image more quickly as compared with the case of providing a cleaner, and the fourth station was faster in the deterioration of image quality than the second station. Then, the invention was applied. As a result, no problem was caused in the image even after printing of 50,000 sheets.

In the cleaner-less process, it is expected that since an exclusive cleaner is not provided, a possibility that the carrier which has once attached to the photoconductor 11 remains long on the photoconductor 11 becomes high; and that a possibility that the carrier particle is carried into an image forming station of a later stage via the intermediate transfer belt 501 becomes high. As a result, it is considered that the subject process is a process which is weak against the carrier attachment, and therefore, it is understood that the invention is very effective.

Since the cleaner-less process is configured such that an exclusive photoconductor cleaner is not provided and the developing agent is electrically recovered by a development unit, the shaving amount of the photoconductor can be minimized. As a result, it should be estimated to realize a long life of the photoconductor. However, when a recess is formed in the photoconductor due to the carrier attachment, a harm is rather likely generated on the image as compared with the case where the photoconductor is largely uniformly shaven by the cleaning blade, resulting in shortening the life. When the invention is applied such that a recess is not formed on the photoconductor, since the shaving amount of the photoconductor is low, an effect for realizing a long life of the photoconductor, an aspect of which is original in the cleaner-less process, can be normally exhibited. Furthermore, in particular, when the amount of the residual transferred toner becomes extremely low because of the foregoing speed difference, high image quality can be stably kept over a long period of time in a cleaner-less process.

Incidentally, in the case of such a cleaner-less process, the effectiveness of the invention varies between the case where the charging of the photoconductor is performed by using a non-contact member such as a corona charger and the case where the charging of the photoconductor is performed by using a contact member such as a charging roller.

In the case of a cleaner-less process, since a cleaning blade is not provided, when the carrier attached to the photoconductor is not transferred, it goes into between the charging member and the photoconductor as it is. For that reason, even when an AC bias voltage is superimposed on the charging roller, the stability of charging is likely lost as compared with the time of corona charging, and as a result, the charging potential is not stable. Thus, the background contrast potential further fluctuates, and the carrier attachment is liable to be generated. As a result, the carrier attachment possibly abruptly increases. That is, in the case of employing a cleaner-less process which is also of a contact charging system, the effectiveness of the invention becomes higher.

Actually, the results obtained by comparing the deterioration level of image in a state to which the invention is not applied between the case of corona charging the charging member at the time of clear-less process and the case of setting up a bias voltage at (DC −750 V)+(AC pp2 kV) by a charging roller are shown in a table of FIG. 12.

As shown in the table of FIG. 12, in the related-art image forming process provided with a cleaner, there was not observed a difference on a white streak or white spot level of the halftone image due to a difference of the charging unit. On the other hand, in the cleaner-less process, in the case of using a charging roller, the image quality was explicitly deteriorated, and the level was better in the case of employing corona charging.

On the other hand, even in the case of employing roller charging, in the image forming apparatus according to the present embodiment, a problem is not generated even after printing of 50,000 sheets. Thus, it has been understood that the invention is effective in the case of a cleaner-less process using a charging roller to which an AC bias voltage has been applied.

Figure 13:
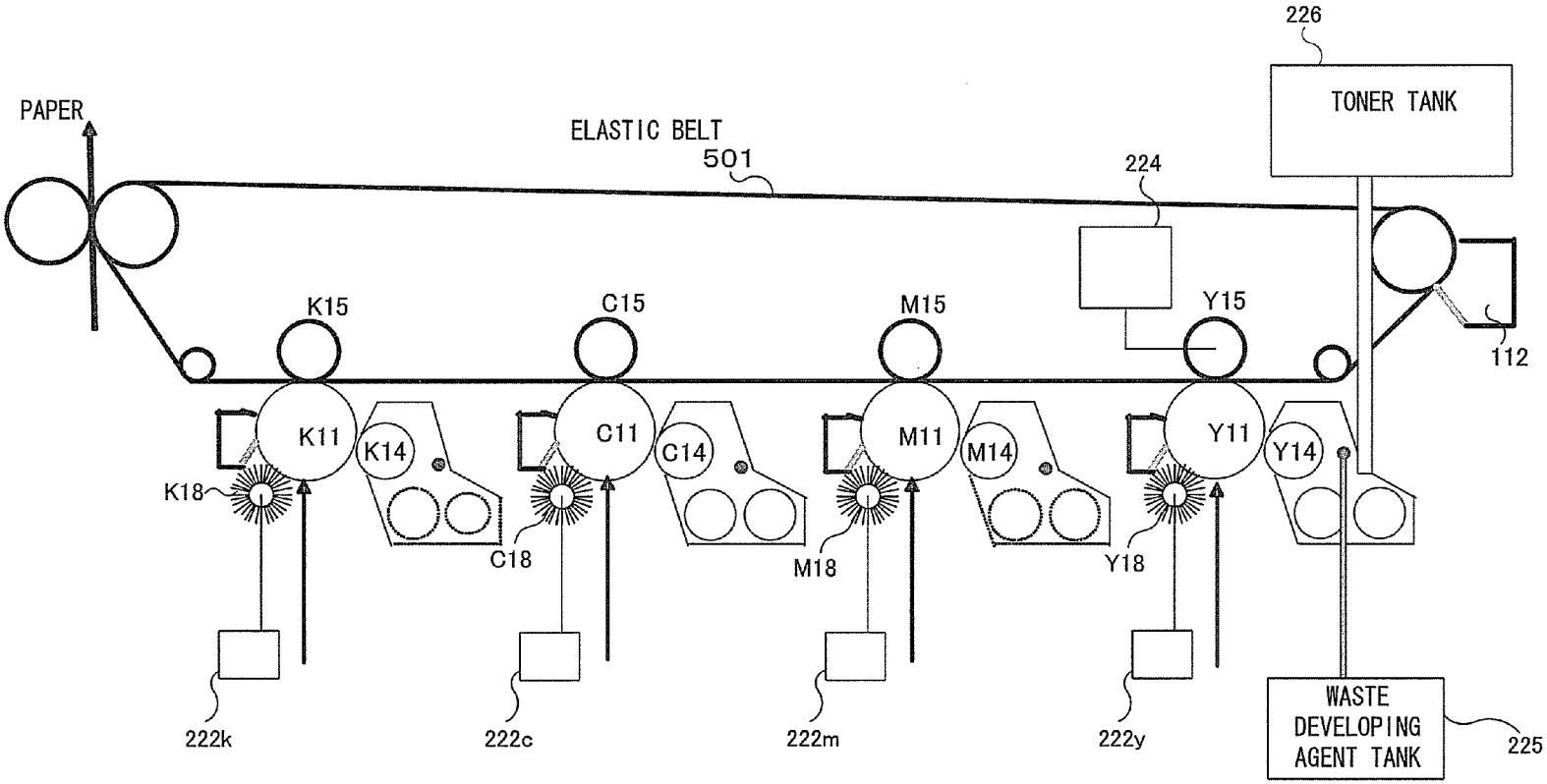
FIG. 13 is a view to show a configuration using a brush-like member in a charging section in each image forming station.

Furthermore, the invention is very effective to not only the cleaner-less process but also a process in which local charging unevenness is liable to be originally generated in the charging section. For example, there is enumerated the case of a configuration of using brush-like members K18, C18, M18 and Y18 in charging sections of respective image forming stations as illustrated in FIG. 13. In these brush-like members K18, C18, M18 and Y18, a prescribed bias voltage is applied by each of charging bias voltage application sections 222*k*, 222*c*, 222*m* and 222*y*, thereby charging a photoconductive surface of the photoconductor.

In a brush charging unit, inherent streak-like charging unevenness is generated, and a charging potential of the charging unevenness portion is at least several tens volts higher than a desired charging potential. Accordingly, in a combination thereof with a two-component development system, the carrier attachment to the photoconductor is liable to be generated.

FIG. 14 is a table to show the experimental results of the apparatus configuration as illustrated in FIG. 13. In this experiment, a nylon-made brush of ϕ14 mm having a fiber size of 4 dtex and having an electrical resistivity of 10e6Ω was used and rotated at a speed of 2 times in the "with" direction against a contact section with the photoconductor, and a DC bias voltage was applied. Furthermore, a life experiment was carried out without controlling the background contrast potential and changing the toner concentration. The experiment was performed without particularly controlling the image density fluctuation of halftone image.

As a result, in the case of employing corona charging (non-contact charging) in the charging section, since as described previously, both the background contrast potential and the toner concentration were fixed, even when the invention was not applied, no problem was caused over a course of printing of 50,000 sheets. However, in the case of using a brush roller as the charging unit, the generation of a white streak and density unevenness was observed after printing of 5,000 sheets, and the deterioration of image quality in the fourth image forming station was vigorous, too.

On the other hand, in the image forming apparatus of the configuration according to the present embodiment, no problem is caused over course of printing of 50,000 sheets in both the second and fourth image forming stations, and therefore, it is understood that the invention is very effective in keeping the image quality.

As described above, even in the case where the carrier attachment slightly occurs on the photoconductive surface of the photoconductor by using an intermediate transfer belt having an elastic surface layer, undulations of the carrier are absorbed by the elastic surface layer, whereby damages on the photoconductor (for example, the generation of a crater-like recess) can be reduced. Furthermore, by bringing the surface of the intermediate transfer belt with elasticity, in secondarily transferring a toner image on the intermediate transfer belt onto paper having irregularities, secondary transfer with excellent follow-up properties and high image quality against rough paper can be realized as compared with the case of a hard belt such as resin belts.

However, when the amount of the developing agent begins to once decrease, such an intermediate transfer belt cannot follow a solid image or the like, and the toner amount abruptly decreases, whereby the image quality maintenance control may possibly become impossible. Thus, when the image quality maintenance control becomes impossible, the toner amount further decreases; the carrier attachment to the photoconductor largely increases; and the carrier attaches in an amount such that it cannot be absorbed by the undulations on the elastic surface layer of the intermediate transfer belt.

Then, in an image forming apparatus employing an intermediate transfer belt having an elastic surface layer as in the present embodiment, when a so-called "developing agent replenishment and discharge development system" is employed to always make the charging characteristics of the developing agent constant corresponding to the fluctuation of the amount of the developing agent, the carrier attachment to the photoconductor is controlled, and as a result, the generation of damages caused by the carrier attachment of the photoconductor can be controlled.

In particular, in the case where for the purpose of realizing high image quality, the process condition is changed by using a small-sized carrier, thereby achieving an image quality maintenance operation, the carrier is liable to attach to the photoconductive surface of the photoconductor, and the toner amount is liable to fluctuate. Accordingly, the effect according to the present embodiment is especially large.

As described above, the present embodiment is an important issue in an image forming apparatus aiming to realize high image quality by employing a small-sized carrier and image quality maintenance control with high precision or an image forming apparatus using a small-sized carrier and a contact charging member. It has been found that a harm caused due to the carrier attachment to the photoconductor in the development section can be overcome by a combination of an intermediate transfer belt having elasticity and a developing agent replenishment and discharge development system. Thus, it has become possible to provide an image forming apparatus from which a full-color image with high image quality is obtainable over a long period of time even when the surrounding environment or the like varies.

In the light of the above, in an image forming apparatus of a quadruple tandem intermediate transfer belt system employing a two-component development system, in a configuration in which an intermediate transfer belt is made elastic and a developing agent is gradually discharged from a developing unit, by controlling a background contrast potential and a toner concentration within the development unit for the purpose of realizing high image quality, even when a carrier attaches to a surface of a photoconductor, the photoconductor is free from damaging and the amount of the developing agent within the development unit does not decrease, and therefore, the high image quality can be kept over a long period of time. The invention is especially effective in using a carrier having a small particle size of not more than 35 μm or in a combination with a cleaner-less process.

Furthermore, the invention is also effective in a color image forming apparatus using two-component development and a brush charging unit, and by combining them, it is possible to provide a small-sized color image forming apparatus with high image quality.

In the present embodiment, while the case where a function for carrying out the invention is previously stored inside the apparatus has been described, it should not be construed that the invention is limited thereto. The same function may be downloaded into the apparatus from a network; or a recording medium having the same functions stored therein may be installed in the apparatus. As the recording medium, any form is employable so far as it is able to store a program therein, such as CD-ROM and the apparatus can read it. Such a function which can be installed or downloaded in advance may be one capable of realizing that function in cooperation with OS (operating system) inside the apparatus or the like.

While the invention has been described in detail and with reference to specific embodiments thereof, it will be apparent to one skilled in the art that various changes and modifications can be made therein without departing from the spirit and scope thereof.

As described above in detail, according to the invention, it is possible to provide a technology for controlling the generation of damages of a photoconductive surface caused due to the attachment of a carrier to a photoconductor in an image forming apparatus using a two-component developing agent.

What is claimed is:

1. An image forming apparatus comprising:

an intermediate transfer body having prescribed elasticity on a transfer surface onto which a toner image is transferred;

plural image carriers which transfer a toner image onto the transfer surface and which are disposed along a movement direction of the transfer surface of the intermediate transfer body;

plural cleaning brushes which are in touch with the corresponding image carrier and clean the residual toner on the corresponding image carrier; and plural development sections which form toner images having a different color from each other with respect to the plural image carriers by using a two-component developing agent made of a toner and a carrier; wherein the transfer surface of the intermediate transfer body has a hardness lower than a hardness of an image carrying surface of each of the image carriers, and is formed so as to have elasticity to such a degree that in the case of sandwiching a carrier particle between the transfer surface and the image carrying surface of the image carrier, the image carrying surface is not scratched.

2. The image forming apparatus according to claim 1, further comprising:

plural chargers which are in touch with the corresponding image carrier and charge the corresponding image carrier.

3. The image forming apparatus according to claim 1, wherein a carrier particle used by plural image carriers has an average particle size of not more than 35 μm.

4. The image forming apparatus according to claim 1, wherein the intermediate transfer body comprises a substrate layer made of resin, an elastic layer, and a surface layer, wherein the elastic layer has a hardness from 20 to 70°.

5. The image forming apparatus according to claim 1, further comprising:

developing agent replenishment sections which replenish a toner and a carrier in the development sections.

6. The image forming apparatus according to claim 1, wherein the plural cleaning brushes have a volume resistivity from 10e4 to 10e10 Ω·cm.

7. An image forming apparatus comprising:

an intermediate transfer body having prescribed elasticity on a transfer surface onto which a toner image is transferred;

plural image carriers which transfer a toner image onto the transfer surface and which are disposed along a movement direction of the transfer surface of the intermediate transfer body;

plural chargers which are in touch with the corresponding image carrier and charge the corresponding image carrier;

plural cleaning brushes which are in touch with the corresponding image carrier and clean the residual toner on the corresponding image carrier;

plural development sections which form toner images having a different color from each other with respect to the plural image carriers by using a two-component developing agent made of a toner and a carrier; and developing agent replenishment sections which replenish a toner and a carrier in the development sections, wherein the transfer surface of the intermediate transfer body has a hardness lower than a hardness of an image carrying surface of each of the image carriers, and is formed so as to have elasticity to such a degree that in the case of sandwiching a carrier particle between the transfer surface and the image carrying surface of the image carrier, the image carrying surface is not scratched, the intermediate transfer body comprises a substrate layer made of resin, an elastic layer, and a surface layer.

8. An image forming apparatus comprising:

an intermediate transfer body having prescribed elasticity on a transfer surface onto which a toner image is transferred;

plural image carriers which transfer a toner image onto tJ:1e transfer surface and which are disposed along a movement direction of the transfer surface of the intermediate transfer body;

plural blush members which are in touch with the corresponding image carriers and charge the corresponding image carrier; and plural development sections which form toner images having a different color from each other with respect to the plural image carriers by using a two-component developing agent made of a toner and a carrier, wherein the transfer surface of the intermediate transfer body has a hardness lower than a hardness of an image carrying surface of each of the image carriers, and is formed so as to have elasticity to such a degree that in the case of sandwiching a carrier particle between the transfer surface and the image carrying surface of the image carrier, the image carrying surface is not scratched.

9. The image forming apparatus according to claim 8, wherein a carrier particle used by plural image carriers has an average particle size of not more than 35 μm.

10. The image forming apparatus according to claim 8, wherein the intermediate transfer body comprises a substrate layer made of resin, an elastic layer, and a surface layer, wherein the elastic layer has a hardness from 20 to 70°.

11. The image forming apparatus according to claim 8, further comprising:

developing agent replenishment sections which replenish a toner and a carrier in the development sections.

12. The image forming apparatus according to claim 8, wherein the blush members rotate at a speed of 2 times as fast as the circumferential speed of the contact part with the blush members on the image carriers.

* * * * *